US005320489A

United States Patent [19]

McKenna

[11] Patent Number: 5,320,489

[45] Date of Patent: Jun. 14, 1994

[54] DIFFUSER FOR A CENTRIFUGAL PUMP

[75] Inventor: John M. McKenna, Port Murray, N.J.

[73] Assignee: Ingersoll-Dresser Pump Company, Liberty Corner, N.J.

[21] Appl. No.: 69,813

[22] Filed: Jun. 1, 1993

[51] Int. Cl.[5] ..... F04D 29/44

[52] U.S. Cl. ..... 415/208.3; 415/199.1

[58] Field of Search ..... 415/208.2, 208.3, 208.4, 415/199.1, 199.2

[56] References Cited

U.S. PATENT DOCUMENTS

| | | | |
|---|---|---|---|
| 3,604,818 | 9/1971 | Cronstedt et al. | 415/207 |
| 3,860,360 | 1/1975 | Yu | 415/211 |
| 3,904,312 | 9/1975 | Exley | 415/181 |
| 3,997,281 | 12/1976 | Atkinson | 415/208.3 X |
| 4,164,845 | 8/1979 | Exley et al. | 60/39.29 |
| 4,344,737 | 8/1982 | Liu | 415/199.1 |
| 4,355,953 | 10/1982 | Nelson | 415/208.3 |
| 4,551,285 | 11/1985 | Jackson | 415/208.3 |
| 4,938,661 | 7/1990 | Kobayashi et al. | 415/199.1 |

FOREIGN PATENT DOCUMENTS

| | | | |
|---|---|---|---|
| 183899 | 10/1983 | Japan | 415/208.3 |

*Primary Examiner*—Edward K. Look
*Assistant Examiner*—Michael S. Lee
*Attorney, Agent, or Firm*—Michael H. Minns

[57] ABSTRACT

A radial diffuser for a centrifugal pump. The diffuser has a plurality of diffusing passages wherein the width of the diffusing passage is constant and the cross-sectional area of the diffusing passage increases from the inlet of the diffusing passage to the outlet of the diffusing passage. This type of diffuser has a reduced outer diameter relative to prior art diffusers.

2 Claims, 4 Drawing Sheets

DIFFUSER FOR A CENTRIFUGAL PUMP

BACKGROUND OF THE INVENTION

This invention relates generally to multi-stage centrifugal pumps and more particularly to diffusers for multi-stage centrifugal pumps.

Multi-stage pumps use a radial diffuser where the width of the diffusing passages increases from the entrance of the passage to the exit passage. The outer diameter of the diffuser is a function of the vane number and the exit height. Typically, reducing the diffuser diameter reduces the pump performance.

The foregoing illustrates limitations known to exist in present centrifugal pump diffusers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a diffuser for a centrifugal pump having an impeller, the diffuser comprising: a plurality of diffusing passages, each diffusing passage having an entrance, an exit and a width, the width of a diffusing passage being constant, the cross-sectional area of a diffusing passage increasing from the entrance to the exit.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
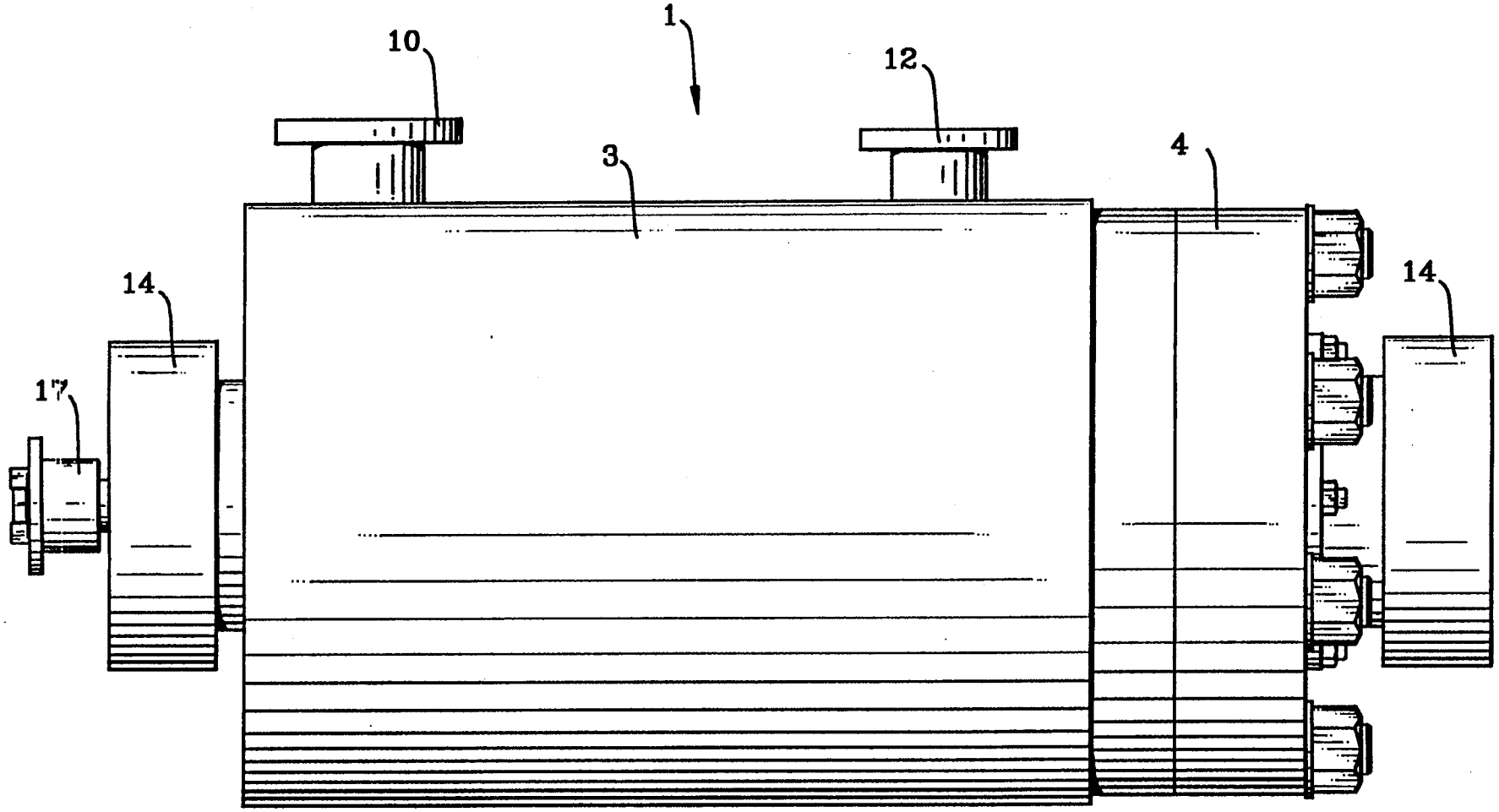
FIG. 1 is a side view of a multi-stage centrifugal pump.

FIG. 1 shows a multi-stage centrifugal pump 1 having an inlet 10 and outlet 12. These multiple stages are enclosed within a pump housing 3. One end of the centrifugal pump 1 is closed by a pump end casing 4 bolted to the pump housing 3. At each end of the centrifugal pump 1 is a bearing housing 14. The shaft 15 is provided with a coupling 17 for connecting the pump 1 to a driving device (not shown) such as an electric motor, steam driven turbine or gas turbine.

Figure 2:
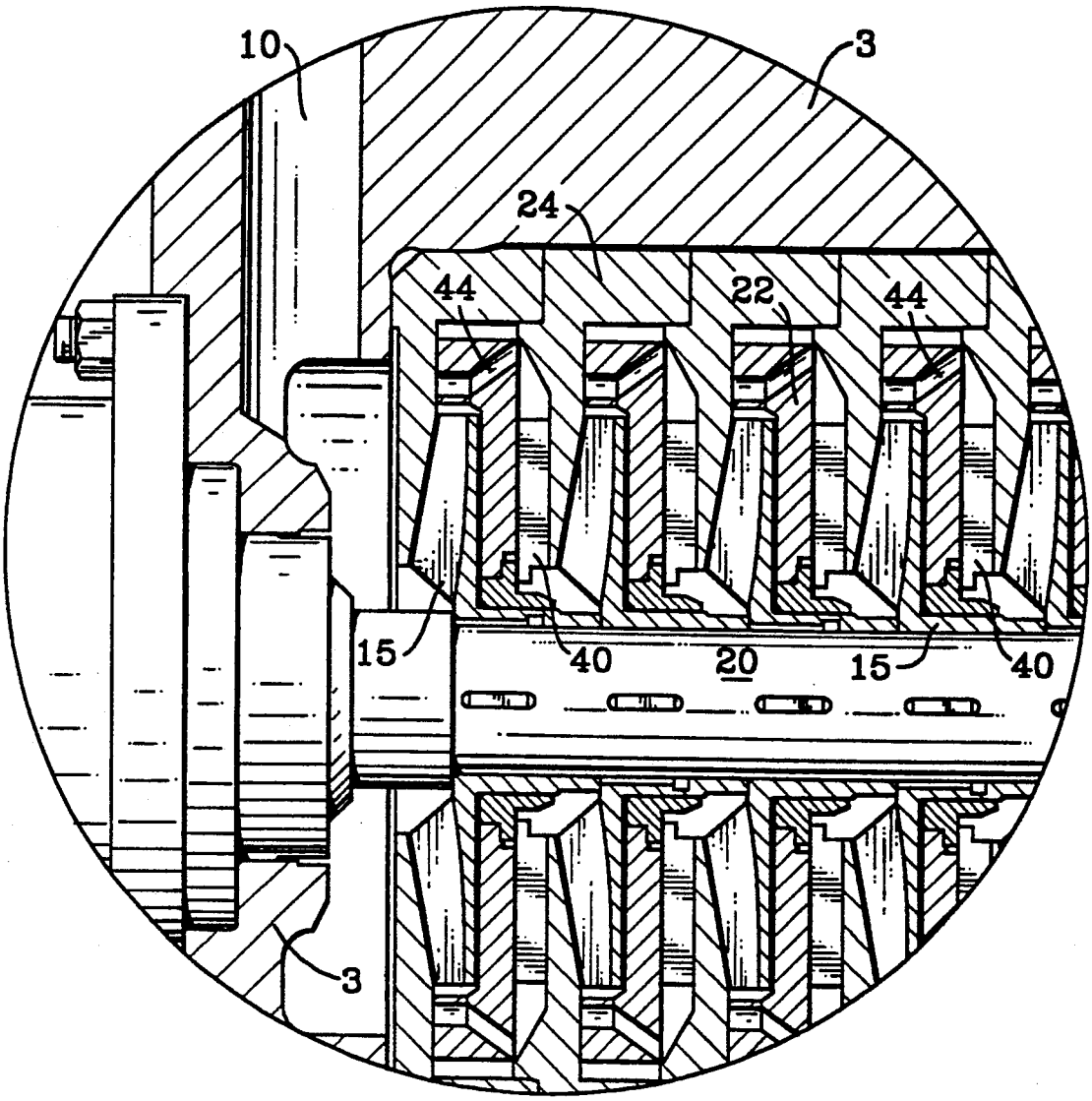
FIG. 2 is a cross-section of a portion of the multi-stage centrifugal pump shown in FIG. 1.

An enlarged view of several stages of the pump internals is shown in FIG. 2. The interior of the centrifugal pump 1 contains a plurality of multiple stages consisting of an impeller 15 attached to a rotating shaft 20, a diffuser 22 and a channel ring with return vanes 24. The pumped fluid enters an impeller 15 attached to a shaft 20. The rotating impeller increases the fluid velocity. The fluid exits the impeller 15 and flows into a diffuser 22 where the increased velocity is converted to increased pressure. The higher pressure fluid then enters a channel ring section 24 containing a plurality of return vanes 40 which guide the fluid to the next stage impeller 15. Additional stages are used as necessary to achieve the required discharge pressure. The stages shown in FIG. 2 are from a twelve stage centrifugal pump.

A radial diffuser is a device which converts the fluid velocity into static pressure. This is accomplished by a decrease in the velocity of a fluid flowing in a passage which is caused by an increase in the area of the passage as seen by the flow traversing through the passage. The diffuser of the present invention has a constant width passage as seen from the axial view and a diverging channel height from the inlet to the exit. Because the diffusing passage has a constant width, a diffuser of the present invention has a reduced outer diameter when compared to a prior art diffuser. The present invention presents a reduced diameter diffuser with classical diffusion rates.

Figure 3:
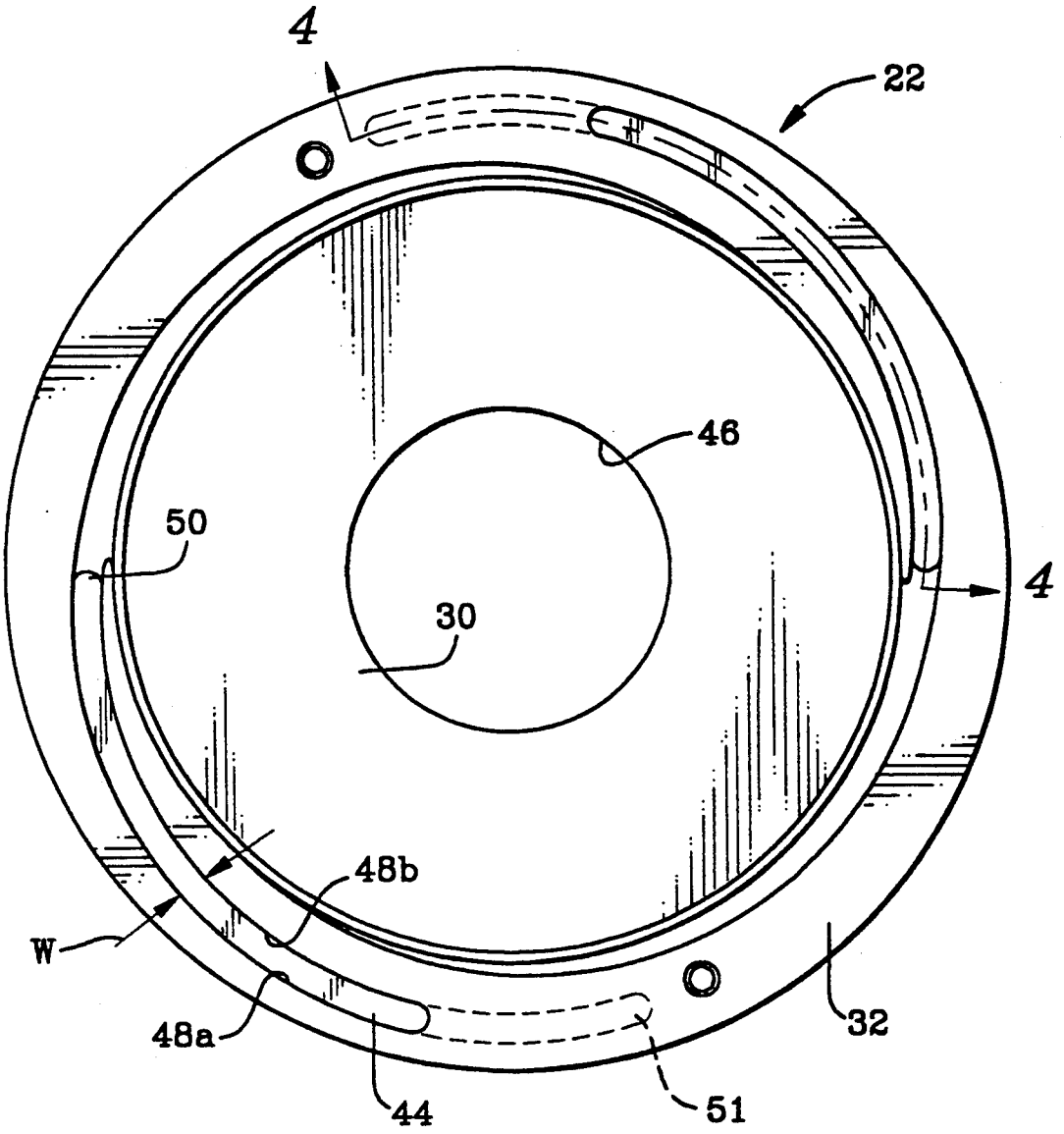
FIG. 3 is a top view of the pump diffuser shown in FIG. 2.
Figure 4:
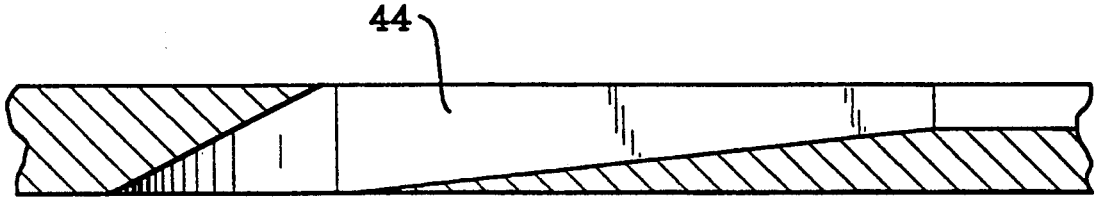
FIG. 4 is a cross-section of a diffuser passage taken along line 4—4 of FIG. 3.

FIG. 3 shows the diffuser 22 from FIG. 2. The diffuser 22 is an annular disk 30 with a thicker integral ring portion 32 at its outer circumference. The inner circumference 46 of the annular disk 30 forms an opening for the pump impeller shaft 20. A plurality of diffuser passages 44 are located in the ring portion 32. FIG. 3 shows two long diffuser passages 44. Each diffuser passage 44 has a constant width w from one diffuser passage side wall 48*a* to the other diffuser side wall 48*b*. As shown in FIG. 4, the depth of the diffuser passage 44 increases from a minimum at an entrance 50 to a maximum at an exit 51. In the preferred embodiment, the increase in diffuser passage 44 depth, and the corresponding diffuser passage 44 cross-sectional area, is constant per unit length.

Figure 7:
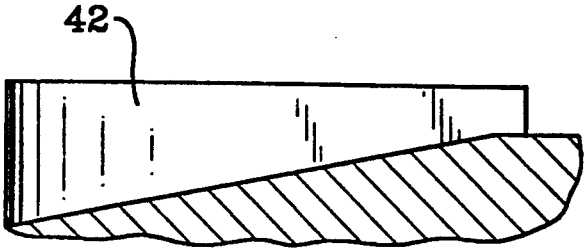
FIG. 7 is a cross-section of a diffuser passage taken along line 7—7 of FIG. 6.
Figure 5:
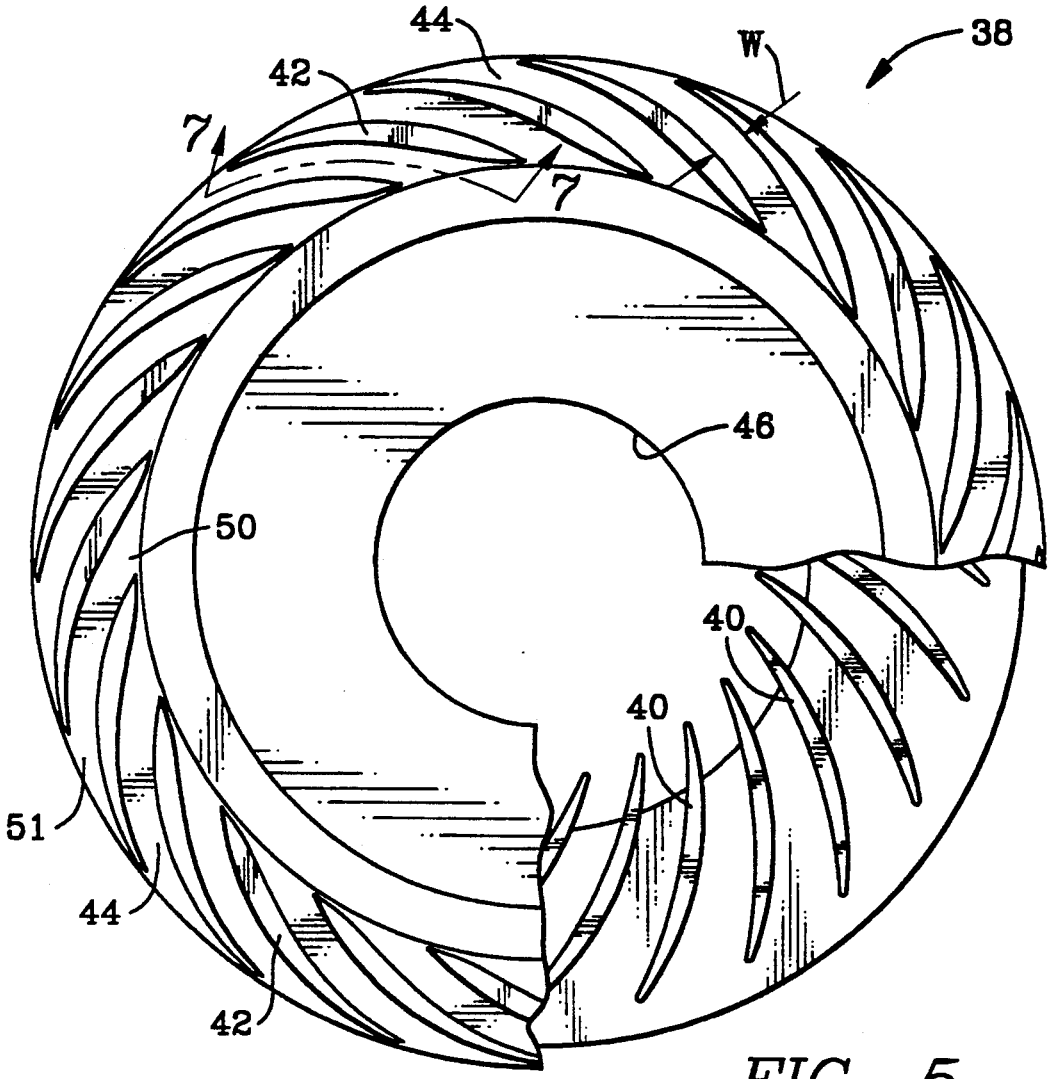
FIG. 5 is a top view of a pump diffuser and return vane assembly incorporating an alternate embodiment of the present invention, a portion of the diffuser section has been removed to show interior details.
Figure 6:
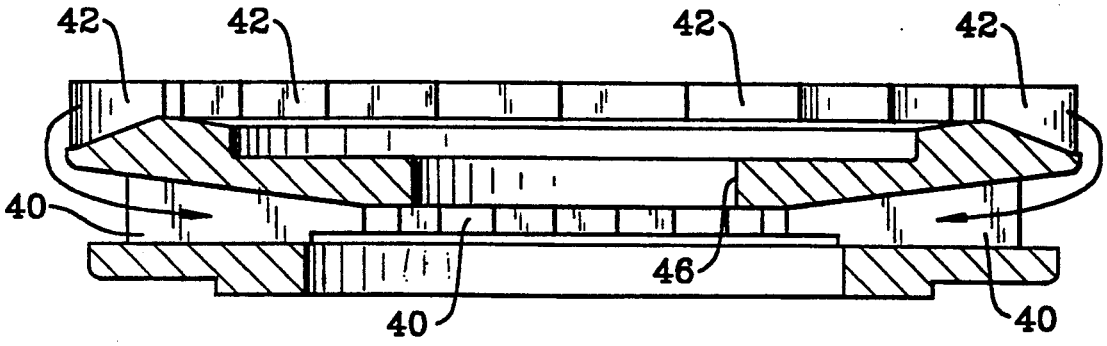
FIG. 6 is a cross-section of the pump diffuser and return vane assembly shown in FIG. 5.

FIGS. 5 through 7 show an alternate embodiment of the present invention. The assembly 38 in FIG. 5 is a combined diffuser and return vane assembly. This assembly 38 can be used in certain centrifugal pumps instead of the separate diffuser 21 and channel ring 24 assemblies shown in FIG. 2.

The upper portion of the combined diffuser and return vane assembly 38, shown in FIGS. 5 and 6, contains a plurality of diffuser passages 44 formed by a plurality of concentric diffusing vanes 42. The width w of a diffuser passage 44 is constant as described above for the diffuser 22 shown in FIG. 3. As shown in FIGS. 5 and 7, the depth of a diffuser passage 44 increases from a minimum at an entrance 50 to a maximum at an exit 51. In the preferred embodiment, the increase in diffuser passage 44 depth, and the corresponding diffuser passage 44 cross-sectional area, is constant per unit length.

From the exits 51 of the diffuser passages 44, the pumped fluid enters the return vanes 40 of the next stage of the multiple stages where the flow is directed as shown by the flow arrows in FIG. 6 to the impeller 15.

Having described the invention, what is claimed is:

1. A diffuser for a centrifugal pump having an impeller, the diffuser comprising:

an annular member having an inner circumference and an outer circumference and a first surface between the inner circumference and the outer circumference and being mounted about the periphery of the impeller; and a plurality of concentric diffuser vanes on the annular member, a diffuser vane, an adjacent diffuser vane and the first surface of the annular member defining three sides of a diffusing passage, the diffusing passage being open on a fourth side opposite the first surface of the annular member, the diffusing passage having an entrance, an exit and a width, the width of a passage being from one diffuser vane to an adjacent vane, the width being constant, the depth of a passage increasing from a minimum proximate the passage entrance to a maximum proximate the passage exit.

2. A diffuser for a centrifugal pump having an impeller, the diffuser comprising:

an annular member having an inner circumference, an outer circumference and a first surface between the inner circumference and the outer circumference, the annular member being positioned about the periphery of the impeller; and the annular member having a plurality of diffusing channels in the first surface, each diffusing channel having two side walls, a bottom surface, an entrance, an exit and a width, the diffusing channel being open on a fourth side opposite the bottom surface, the width of a diffusing channel from one side wall to the other side wall being constant, the depth of a diffusing channel increasing from the entrance to the exit.

* * * * *